US006842919B2

(12) United States Patent
Wilson et al.

(10) Patent No.: US 6,842,919 B2
(45) Date of Patent: Jan. 18, 2005

(54) SHOWER CHAIR

(76) Inventors: Gwendolyn Frances Wilson, 12108 Clear Creek Dr., Ft. Washington, MD (US) 20744; Tina N. Johnson, 12108 Clear Creek Dr., Ft. Washington, MD (US) 20744

( * ) Notice: Subject to any disclaimer, the term of this patent is extended or adjusted under 35 U.S.C. 154(b) by 0 days.

(21) Appl. No.: 10/628,371

(22) Filed: Jul. 29, 2003

(65) Prior Publication Data

US 2004/0070237 A1 Apr. 15, 2004

Related U.S. Application Data

(60) Provisional application No. 60/406,670, filed on Aug. 29, 2002.

(51) Int. Cl.[7] ..... A47K 3/022

(52) U.S. Cl. ..... 4/578.1; 4/611; 297/180.15

(58) Field of Search ..... 297/180.15; 239/289, 239/506, 513; 4/578.1, 579, 560.1, 597, 601, 611

(56) References Cited

U.S. PATENT DOCUMENTS

| | | | | | |
|---|---|---|---|---|---|
| 3,040,335 | A | * | 6/1962 | Gellmann | 4/570 |
| 3,169,253 | A | * | 2/1965 | Segar | 4/611 |
| 5,063,621 | A | * | 11/1991 | Sellars | 4/568 |
| 5,940,905 | A | * | 8/1999 | Cheng | 4/578.1 |
| 6,089,655 | A | * | 7/2000 | Colman | 297/180.15 |
| 6,182,304 | B1 | | 2/2001 | Freeberg | |
| 6,195,814 | B1 | * | 3/2001 | Yoshida et al. | 4/601 |
| 6,226,810 | B1 | | 5/2001 | Weddendorf et al. | |
| 6,256,806 | B1 | * | 7/2001 | DiTommaso | 4/560.1 |
| 6,279,178 | B1 | | 8/2001 | Hill | |
| 6,681,415 | B1 | * | 1/2004 | Gallo | 4/560.1 |

* cited by examiner

*Primary Examiner*—Peter R. Brown
(74) *Attorney, Agent, or Firm*—Sughrue Mion, PLLC

(57) ABSTRACT

The present invention relates to a chair device for assisting handicapped or non-ambulatory persons to bathe or shower in a conventional setting. The chair device of the present invention has side flap portions provided with water dispensing holes wherein the side flap portions are pivotally attached to a seat portion to aid in reaching hard to reach areas of the body when bathing.

18 Claims, 4 Drawing Sheets

SHOWER CHAIR

This application claims the benefit of U.S. Provisional Application No. 60/406,670 filed on Aug. 29, 2002, which is incorporated herein by reference.

BACKGROUND OF THE INVENTION

The present invention relates to a multifunctional chair device used for assisting handicapped persons or persons of limited ambulatory ability with respect to bathroom facilities. More specifically, this invention relates to a device for assisting persons with limited ambulatory ability to bathe or shower and/or enter a bathtub or shower stall in a conventional setting.

One particularly important and common daily task is that of showering or bathing. The combination of water and slippery surfaces of floors, tubs and shower stalls in bathroom facilities increases the risk of slipping and falling for handicapped persons or persons with limited ambulatory ability. Furthermore, a tub wall can be an immense obstacle for a handicapped or ambulatory impaired person.

Currently there exists many devices for assisting handicapped or physically challenged or impaired persons. Examples of such devices include chairs that slide on rails to help move non-ambulatory persons into a standard residential bathtub, transfer benches that allow a person to sit in a bathtub and bathing chairs having conduits disposed within the seat and back member for channeling water through. However, many prior art devices have limited utility beyond providing a seating function making such devices relatively less versatile. On the other hand, some devices are unusually complex in design and are relatively expensive to build and maintain. Other chairs are extremely difficult to operate and are intimidating to handicapped or ambulatory impaired persons. These chairs often require the help of a skilled worker, which is generally not feasible or desired in a home setting as opposed to institutional settings.

Another drawback of prior art chair bathing devices is that they are not conducive for reaching the hard to reach areas such as the sides and back of the body, especially for a person who is handicapped and/or physically impaired or challenged.

Therefore there is a need for a chair used for bathing that overcomes the drawbacks of the prior art. Such a chair must have a range of functionality, must be relatively simple in design and operation and must be usable by most individuals without assistance. Such a chair should also provide functionality for a caregiver if one is employed.

SUMMARY OF THE INVENTION

The chair device of the present invention addresses the aforementioned needs in the art. The chair device is a multifunctional chair for use in either a bathtub or shower environment. The chair device is of a relatively simple design and construction is made easy using standard manufacturing methods. The device is relatively simple to operate and can be used by most individuals unassisted. If a caregiver is providing assistance, the device is user friendly.

One embodiment of the chair device of the present invention comprises a base member having a first side, a second side, a front, a back, a top, and a bottom. A plurality of legs extend downwardly from the bottom of the base member. A seat portion comprising a seat member and a back support member is attached to the top of the base member. The back support member is fixedly coupled to the back edge of the seat member. A first flap portion is attached to a first side of the back support member and a second flap portion is attached to the second side of the back support member, wherein the first and second flaps are each provided with holes in the front side of each flap portion. Openings are provided in at least one of the plurality of legs, the base member, the seat member, the back support member, and the flap portions for providing a conduit.

At least one conduit for channeling fluid and/or dispensing fluid therefrom is provided in at least one of the plurality of legs, the base member, the seat member, the back support member and the first and second flaps. The at least one conduit has an inlet port adapted to be attached to a fluid source.

The chair device of the present invention may optionally be provided with a flexible shower head and the legs of the chair may be adjustable to adjust the height of the chair according to the person using it and/or to adapt the shower chair device of the present invention for use in various bathing environments.

The chair device of the claimed invention has first and second flaps which are pivotally attached to the first and second sides, respectively, of the back support member. The flaps each have dispensing holes for dispensing water or fluid to the user of the chair from the conduits or water supply lines disposed in the openings of the chair. The flaps open and close to allow a person to slide onto the seat. During use, the flaps may be moved inwardly toward the user so that water or fluid may be directed at the sides of the user to facilitate bathing and reaching hard to reach areas.

The chair device of the present invention may further comprise dispensing holes in the seat member and back support member of the seat portion and a means for starting and stopping the flow of fluid through said at least one conduits, such as an on/off switch or any other suitable means.

In another embodiment, the chair device of the present invention is adapted for transferring a person into a bathing environment, wherein the seat portion having first and second flaps provided with water or fluid dispensing holes is slidably attached to the base member by any suitable means. Once the person is transferred into the desired bathing environment, the flaps can be moved inwardly to dispense water or fluid to the user to aid in bathing and reaching hard to reach areas on the sides and back of the body.

BRIEF DESCRIPTION OF THE DRAWINGS

Similar reference numbers refer to similar parts throughout the several views of the drawings.

DETAILED DESCRIPTION OF THE INVENTION

Figure 1:
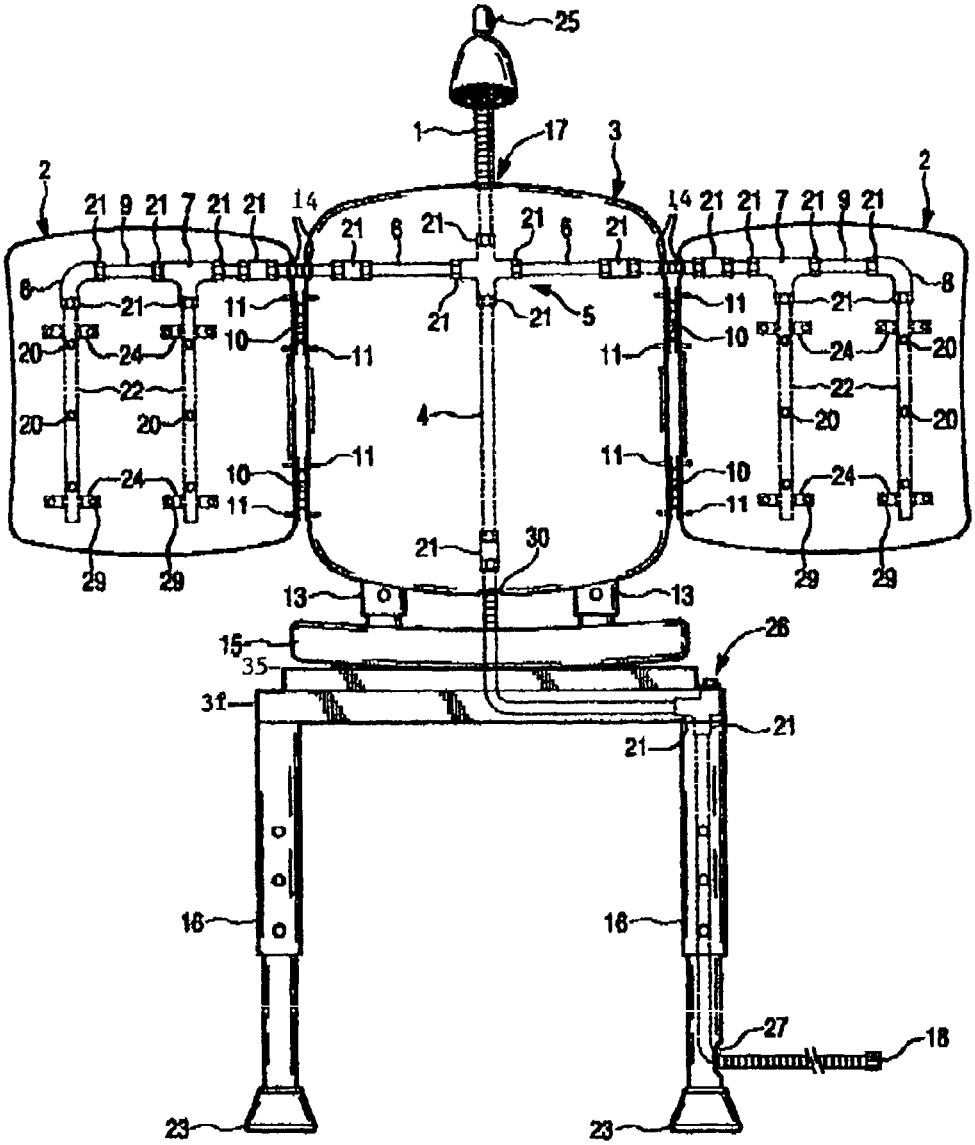
FIG. 1 is a front elevational view of the chair device of the present invention.

Referring now to the drawings, that chair device of the present invention comprises a base member 31 having a first side, a second side, a front, a back, a top, and a bottom. The base member is preferably 21" to 26" wide to accommodate standard and soaking tubs or walk in showers. A plurality of legs 16 extend downwardly from the bottom of the base member 31. The legs 16 are preferably adjustable. The preferably adjustable legs are comprised of first smaller diameter tubular members and larger diameter tubular members which are telescopically mounted with respect to each other. A plurality of holes spaced approximately 2" apart are provided in the first smaller diameter tubular members and the larger diameter tubular members disposed in a line extending lengthwise. Thus when the smaller diameter tubular member is telescopically mounted within the larger diameter tubular member a pin or any other suitable type of fastener may extend through the holes to adjust the telescopic length of the legs of the chair. Preferably 4 or 6 adjustable legs that adjust up to 28" are used depending on whether the chair is stationary or has a sliding seat. Rubber stoppers 23 are attached to the legs.

A seat member 15 is attached by a suitable means for attachment 35 to the top of the base member 31. Where the seat is stationary as in FIGS. 1 and 2, the seat member 15 may be attached to the base member by molding, bolting or any other suitable means. The seat member 15 has a top side, a bottom side, a front edge and a back edge.

Figure 2:
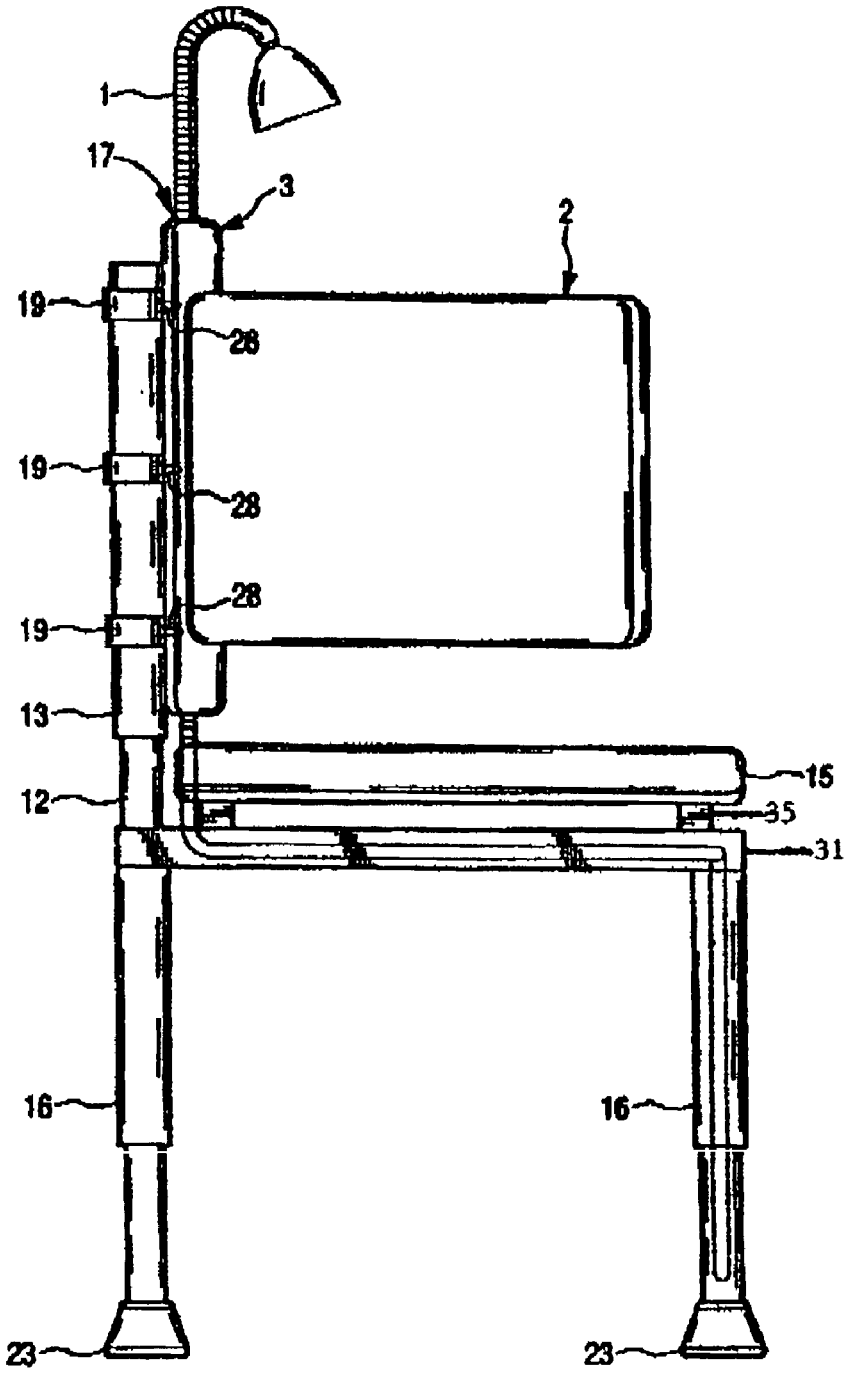
FIG. 2 is a side elevational view of the chair device of the present invention.

A back support member 3 having a first side, a second side, a top edge, a bottom edge, a front side and a back side is attached to the base member by an adjustable means such as chair back support tubes 13 that are attached to the back side of the back support member 3 and which are telescopically coupled with chair back support bars 12, that are attached to the base member 31 by any suitable means. A plurality of holes are provided in a line extending lengthwise in the back support tubes and the back support bars so that when the bars are telescopically mounted within the larger diameter tubes a pin or any other suitable type of fastener may extend through the holes to adjust the height of the back support member of the chair. Chair support brackets 19 and bracket screws 28 are used to attach the adjustable chair back support tubes 13 to the back support member 3. At least two adjustable chair back support bars 13, chair back support bars 12, support brackets 19 and chair back support bracket screws 28 are provided on the back side of the back support member 3 and are used to attach the back support member 3 to the base member 31 as shown in FIG. 2. The adjustable bar preferably has the capability of extending up to 5".

Figure 3:
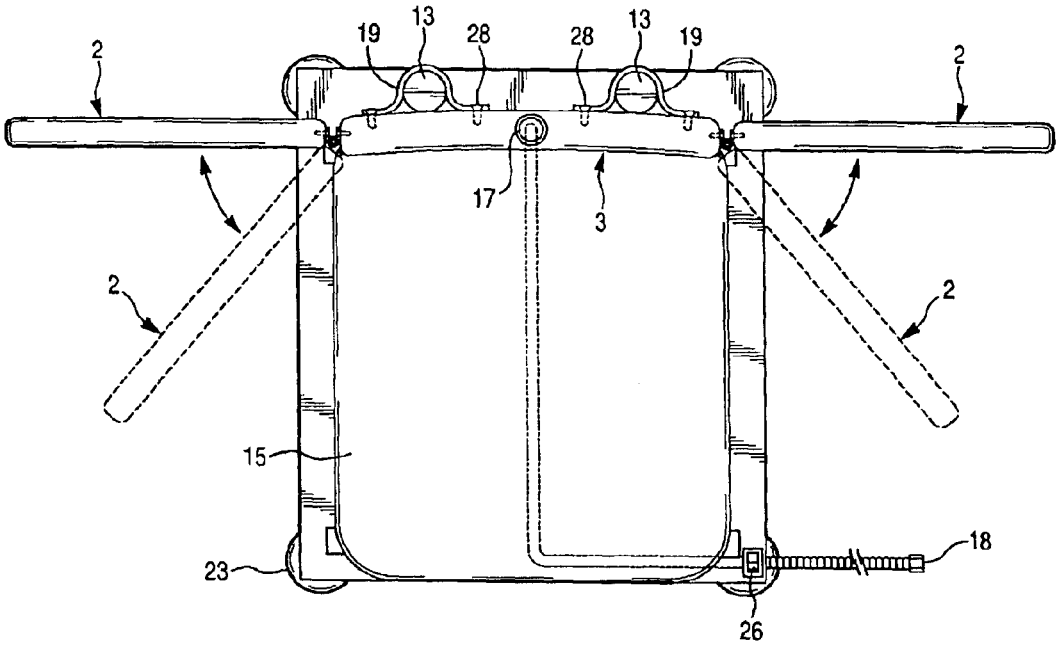
FIG. 3 is a top plan view of the chair device of the present invention.

Side flap portions 2 are attached to the back support member 3 using hinges 10 and hinge screws 11 to allow for opening and closing the side flap portions and for folding the side flap portions inwardly as shown in FIG. 3. The side flap portions preferably range in height from 18" to 25" and are about 18" wide. Fluid or water dispensing holes 20 are provided in the front side of each flap portion. The water dispensing holes are preferably spaced about 2" apart. Openings 14, 27, 30, 32 and 33 are provided in at least one of the plurality of legs, the base member, the seat member, the back support member, and the flap portions for providing a conduit such as a flexible water supply line for providing water or fluid to the dispensing holes and/or a flexible shower head adapter 1. The water supply line is provided in the opening in the chair leg 27 through the opening in the base member 32, through openings in the seat member 33, through opening 30 in the bottom edge of the back support member 3, through the openings 14 on the sides of the back support member and through the openings 14 on the sides of the side flap portions 2. Couplers 21, cross connectors 5, T-connectors 7, and elbow connectors 8 are used to connect the center water supply line 4 to the water supply lines 6 to the side flap portions 2 and the water supply lines 9 in the side flap portions 2 and the water lines 22 leading to the water dispensing holes 20. The water supply line may also be provided to run through the adjustable bar 12 in the rear of the back support member of the chair. Water line brackets 24 and bracket screws 29 are used to secure the water lines in the side flap portions 2. A means 18 for attaching the water supply line to a faucet is provided at the inlet of the water supply line in the adjustable leg. The means 18 for attaching the water supply line to a faucet can be adapted to accommodate tubs or showers with a right and a left faucet. The type of faucet will determine the length and type of connector required for the water supply line. A shower water supply line or a cap stopper 17 is provided at the top of the back support 3 depending on whether an optional shower head adapter 1 is attached to the chair device of the present invention. If a shower head is employed a valve 25 is provided on the shower head adapter for starting and stopping the flow of water. A means for starting and stopping the chair water supply such as a valve 26 is also provided on the chair device.

Figure 4:
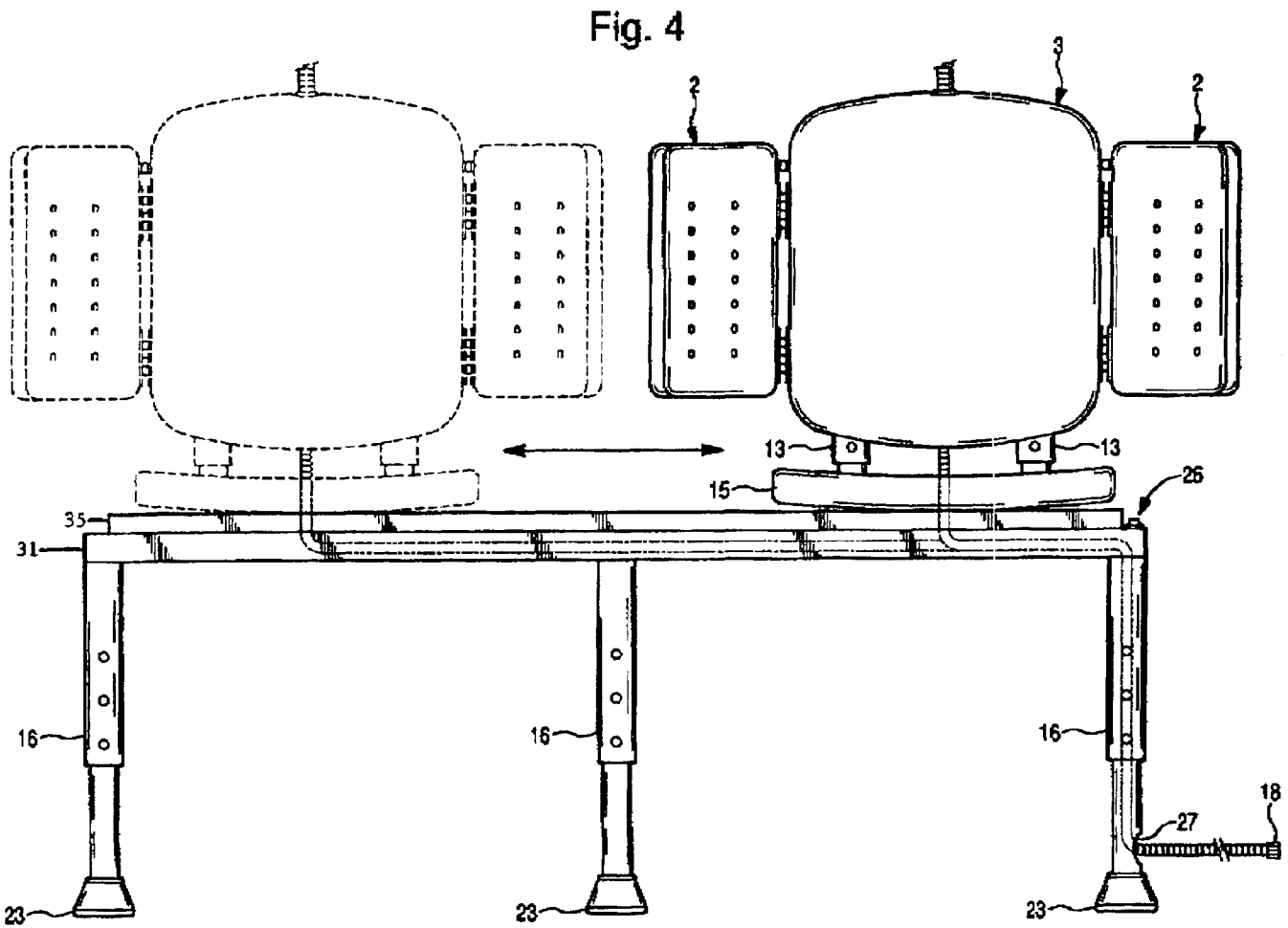
FIG. 4 is a front elevational view of chair device of the present invention adapted for transferring a person using the device.

FIG. 4 shows the embodiment of the present invention wherein the chair device is slidably attached to the base member for transferring the user. In this embodiment, six (6) adjustable legs are used to accommodate standard or soaking tubs. Preferably the legs are approximately 15" apart on the inside of the tub for standard tubs and approximately 16" from the middle leg on the outside of the tub. For soaking tubs, the legs are preferably approximately 23" apart on the inside of the tub and 26" from the middle leg on the outside of the tub. The seat preferably slides on rust proof 5¼" steel bars or rails 34 that have a capacity to hold up to 300 lbs. Preferably at least three (3) bars are used.

In order to use the shower chair device of the present invention, the device is positioned within a bathing environment such as a tub or shower. The chair can be adjusted as desired by adjusting the legs and the back support member to accommodate the user. The inlet portion of the water supply line is connected to a faucet or water supply, which is adjusted to a comfortable temperature for the user. When turned on, the water passes through the water supply line and is discharged through the water dispensing holes to the user and shower head, if attached. The user can move the side flap portions inward towards the body so that water from the water dispensing holes in the side flap portions can reach the sides and back of the body. The water is allowed to be drained through the bathtub or shower drain.

Because the shower chair device of the present invention is designed to be used in the presence of water and soap and other cleaning materials, plastic, such as PVC, non-corrosive material or corrosive resistant materials are used in constructing the chair device of the present invention.

With respect to the above description, it is to be realized that the optimum dimensional relationships for the parts of the invention, to include variations in size, materials, shape, form, function and manner of operation, assembly and use, are readily apparent and obvious to one skilled in the art, and all equivalent relationships to those illustrated in the drawings and described in the specification are intended to be encompassed by the present invention.

Therefore the following is considered illustrative only for the principles of the invention. Further, since numerous modifications and changes will readily occur to those skilled in the art, and since it is not desired to limit the invention to the exact construction and operation shown and described, all suitable modifications and equivalents may be resorted to, falling within the scope of the invention.

What is claimed is:

1. A chair device comprising:

a base member having a first side, a second side, a front, a back, a top, and a bottom;

a plurality of legs extending downwardly from the bottom of said base member;

a seat member attached to the top of said base member, said seat member having a top side, a bottom side, a front edge and a back edge;

a back support member attached to the base member by an adjustable means, said back support member having a first side, a second side, a top edge, a bottom edge; and a first flap portion attached to the first side of said back support member and a second flap portion attached to said second side of said back support member, wherein said first and second flaps are each provided with a right edge, a left edge, a front side, a back side and a top edge and bottom edge and wherein dispensing holes are provided in the front side of each flap portion;

wherein at least one conduit for channeling fluid and/or dispensing fluid is provided in at least one of the plurality of legs, the base member, the seat member, the back support member, and the flap portions.

2. The chair device according to claim 1, wherein said at least one conduit has an inlet port adapted to be attached to a fluid source.

3. The chair device according to claim 1, wherein the adjustable means for attaching the back support member to the base member is telescopically coupled chair back support tubes and chair back support bars having holes and a fastening mechanism.

4. The chair device according to claim 1, wherein the device is provided with a shower head.

5. The chair device according to claim 1, wherein said first and second flaps are pivotally attached to said first and second sides, respectively, of said back support member.

6. The chair device according to claim 1, wherein the legs are adjustable.

7. The chair device according to claim 1, wherein the legs are provided with rubber stoppers.

8. The chair device according to claim 1, wherein the device is provided with a means for starting and stopping the flow of fluid through said at least one conduit.

9. The chair device according to claim 8, wherein the means for starting and stopping the flow of fluid is a valve.

10. A chair device for transferring a person into a bathing environment, comprising:

a base member having a first side, a second side, a front, a back, a top, and a bottom;

a plurality of legs extending downwardly from the bottom of said base member;

a seat member attached to the top of said base member, said seat member having a top side, a bottom side, a front edge and a back edge;

a back support member attached to the base member by an adjustable means, said back support member having a first side, a second side, a top edge, a bottom edge; and a first flap portion attached to the first side of said back support member and a second flap portion attached to said second side of said back support member, wherein said first and second flaps are each provided with a right edge, a left edge, a front side, a back side and a top edge and bottom edge and wherein dispensing holes are provided in the front side of each flap portion;

wherein at least one conduit for channeling fluid and/or dispensing fluid is provided in at least one of the plurality of legs, the base member, the seat member, the back support member, and the flap portions; and wherein said base member is provided with a plurality of rails and said seat portion fixedly coupled to said back support portion having first and second flaps attached to first and second sides, respectively, of the back support portion is slidably attached to said base member.

11. The chair device of claim 10, wherein said at least one conduit has an inlet port adapted to be attached to a fluid source.

12. The chair device according to claim 10, wherein the adjustable means for attaching the back support member to the base member is telescopically coupled chair back support tubes and chair back support bars having holes and a fastening mechanism.

13. The chair device according to claim 10, wherein the device is provided with a shower head.

14. The chair device according to claim 10, wherein said first and second flaps are pivotally attached to said first and second sides, respectively, of said back support member.

15. The chair device according to claim 10, wherein the legs are adjustable.

16. The chair device according to claim 10, wherein the legs are provided with rubber stoppers.

17. The chair device according to claim 10, wherein the device is provided with a means for starting and stopping the flow of fluid through said at least one conduit.

18. The chair device according to claim 10, wherein the means for starting and stopping the flow of fluid is a valve.

* * * * *